United States Patent [19]

Slattery

[11] Patent Number: 4,522,132

[45] Date of Patent: Jun. 11, 1985

[54] CUT/LOOP HOOK FOR TUFTING MACHINES

[75] Inventor: Ian Slattery, Hixson, Tenn.

[73] Assignee: Spencer Wright Industries, Inc., Chattanooga, Tenn.

[21] Appl. No.: 583,688

[22] Filed: Feb. 27, 1984

[51] Int. Cl.[3] ..... D05C 15/00

[52] U.S. Cl. ..... 112/79 R

[58] Field of Search ..... 112/79 R, 79 A

[56] References Cited

U.S. PATENT DOCUMENTS

| | | | |
|---|---|---|---|
| 3,138,126 | 6/1964 | Card | 112/79 R |
| 4,048,930 | 9/1977 | Card | 112/79 A |
| 4,134,347 | 1/1979 | Jolley et al. | 112/79 A |
| 4,155,319 | 5/1979 | Short | 112/79 R |
| 4,185,569 | 1/1980 | Inman | 112/79 R |

*Primary Examiner*—Ronald Feldbaum

*Attorney, Agent, or Firm*—Alan Ruderman

[57] ABSTRACT

A combination cut/loop hook and clip for tufting machines in which the mounting portion of the hook remote from the beak includes a longitudinal groove for receiving the tail portion of the clip. The groove includes a pair of female formations in the form of holes for receiving corresponding male formations on the clip tail portion in a detachable press-fit relationship. The spacing between the formations are such that the crease of the enlarged portion of the clip properly resiliently engages the beak. A worn clip may be readily removed from the hook and replaced by another clip without discarding a useable hook.

7 Claims, 6 Drawing Figures

CUT/LOOP HOOK FOR TUFTING MACHINES

BACKGROUND OF THE INVENTION

This invention relates to tufting machines and more particularly to a cut/loop hook and the mounting of a clip thereon.

In a tufting machine a multiplicity of yarn carrying needles penetrate a backing material to insert loops of yarn therein which loops are seized and shed by a looper to produce loop pile or are seized and maintained by a hook and thereafter cut by a knife to produce cut pile. To produce loop and cut tufts in the same row of stitching it is now notoriously well known to use a spring clip secured to a cut pile hook and biased against the bill of the hook. This basic procedure is illustrated in Card U.S. Pat. No. 3,084,645 in which the amount of yarn fed to the needles is controlled so that on selective stitches less yarn is fed to a selective needle to backdraw yarn from a previous loop to cause that loop to force the spring clip away from the bill of the hook and be withdrawn from the hook to form an uncut loop. When sufficient yarn is fed to the needle no yarn is backdrawn from the previous loop and the loop remains on the hook and is later cut by a knife.

As the gauge of the tufted products have gradually decreased, i.e., the spacing between adjacent rows of stitches and thus between respective needles, loopers or hooks, various looper and hook mounting constructions have been developed. For example, modules have been developed wherein the shanks of respective loopers or hooks are embedded in a common body member in side-by-side disposition. Such constructions are illustrated in Bardsley U.S. Pat. No. 4,303,024 and Biggs et al U.S. Pat. No. 4,313,388. Such construction substantially eliminates the difficulties of aligning hooks or loopers in a respective hook or looper bar of the tufting machine since the hooks or loopers are aligned in a jig during the formation of the module. Moreover, to produce cut/loop a module has been developed as illustrated in Bardsley U.S. Pat. No. 4,241,675 in which the hooks are mounted in a first body member and the clips are mounted in a second body member and the body members are adapted and arranged to locate the hooks and clips in the requisite cooperative relationship.

One difficulty with the modular construction is that of replaceability of a broken gauge part, i.e., a hook, looper or clip. If a gauge part breaks then the entire module must be removed and replaced, the module including the unbroken gauge parts generally being discarded or returned for remanufacture. For fine gauge machines, such as 1/16 of an inch and smaller, this problem is justified by the advantages of precise alignment of the gauge parts and reduced deflection. For coarser gauges in the order of ⅛ to 1/10 inch, however, from a cost effectiveness standpoint rapid replaceability of a broken gauge part may be more significant than the advantages of a module. For this reason gauge part mounting blocks have been developed which permit the body and shank of the loopers or hooks to be supported over a large area, have accurate reference positioning surfaces, have means for securing the loopers or hooks in the block firmly, and yet permit individual gauge parts to be replaced. Such a construction is illustrated in Ingram copending U.S. patent application Ser. No. 524,150, filed Aug. 18, 1983, and assigned to the common assignee of the present invention. However, no effective means for providing cut/loop has been developed for such gauge part mountings. Thus, although it may be desirable to use a clip mounting as disclosed in the aforesaid Bardsley U.S. Pat. No. 4,241,675, nevertheless, with that construction when one clip is broken an entire module of clips must be replaced.

There have been attempts in the past to mount the spring clip of a cut/loop hook on the hook shank in such a manner that the clip does not protrude beyond the face of the hook shank. In Japan one manufacturer has attempted to produce such a construction which utilized a hook having a slot in the shank for receiving the shank of a spring clip, the clip being conventionally riveted or spot welded to the shank of the hook. With such a construction, however, if a clip is broken the entire hook and clip must be removed from the mounting block and replaced by another similar combination hook and clip. Such construction becomes impracticable with the gauge part mounting blocks of the aforesaid Ingram patent application, and since a clip is a relatively small cost component of the total cost of a cut/loop hook-clip combination, the need to discard such a combination on account of damage to or failure of a single clip represents a financial burden out of all proportion to the fault. Moreover, hooks and needles wear-in together and it is best to retain the same hook with a particular needle whenever possible.

SUMMARY OF THE INVENTION

Consequently, it is a primary object of the present invention to provide a cut/loop hook for a tufting machine having a spring clip which may be removed and replaced from the hook rapidly.

It is another object of the present invention to provide a cut/loop hook for a tufting machine in which the spring clip is firmly but not permanently mounted on the hook.

It is a further object of the present invention to provide a readily replaceable clip for a cut/loop hook, the hook having a hook receiving groove in the shank thereof, and the hook and clip having cooperating fastening means for positioning, aligning and removeably attaching the clip to the hook.

Accordingly, the present invention provides a cut/loop hook and clip in which the mounting shank of the hook includes an elongated groove of a depth substantially equal to the thickness of the clip, the clip being positioned within the groove and fastened therein by cooperatively mating members disposed for locating and biasing the spring portion of the clip against the bill of the hook. In the preferred form the mating members comprise cooperating male and female formations, the male members being press fit into the female members and readily extracted manually when the clip requires replacement. For ease of manufacture it is preferred that the male members merely comprise small protuberences or dimples extending from the face of the shank of the clip while the female members be recesses or holes formed in the groove in the shank of the hook. With a construction as provided by the present invention, when a clip is worn, broken or must otherwise be discarded, the hook and clip may be removed from the mounting block, the clip removed from the hook and replaced with another clip, and the combination hook with the new clip inserted into the mounting block. There is thus no need to replace the hook per se until it is defective.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
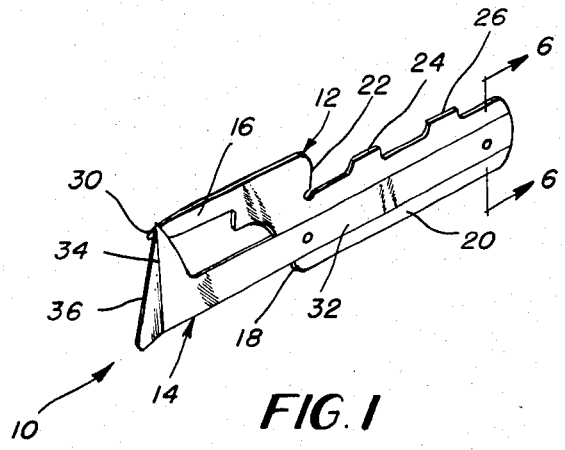
FIG. 1 is a perspective view of a cut/loop hook and a clip constructed in accordance with the principles of the present invention.
Figure 2:
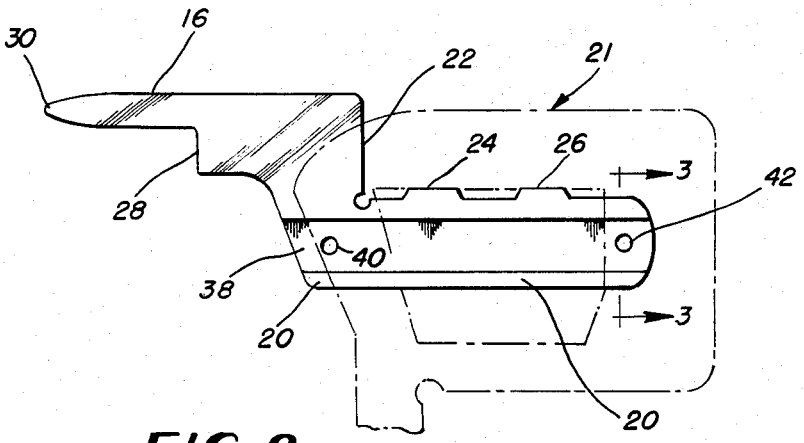
FIG. 2 is a side elevational view of the hook illustrated in FIG. 1 with the clip removed and depicting in phantom a hook mounting block to illustrate the disposition of the hook therein.
Figure 3:
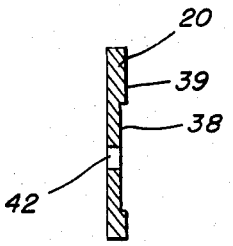
FIG. 3 is a cross-sectional view taken substantially along line 3—3 of FIG. 2.
Figure 4:
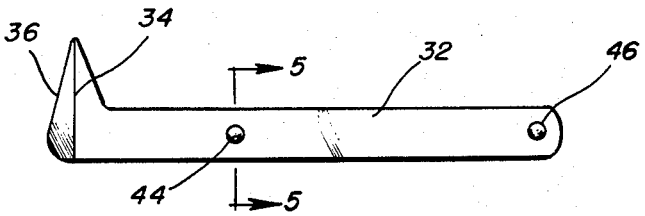
FIG. 4 is a side elevational view of the clip illustrated in FIG. 1.
Figure 5:
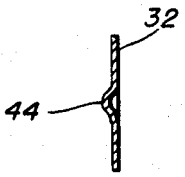
FIG. 5 is a cross-sectional view taken substantially along line 5—5 of FIG. 4.
Figure 6:
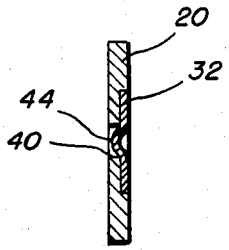
FIG. 6 is a cross-sectional view taken substantially along line 6—6 of FIG. 1.

Referring to the drawings and in particular to FIG. 1, a cut/loop hook and clip combination are illustrated at 10, the hook generally being designated at 12 while the clip is designated at 14. The hook 12 is a substantially planar member having a body portion comprising a blade 16 and a shank 18 including an elongated mounting portion 20 extending rearwardly relative to the blade for positioning within a hook mounting block 21 such as disclosed in the aforesaid Ingram U.S. application Ser. No. 524,150 and which is illustrated in phantom in FIG. 2. The rear edge of the blade forms a neck 22 which extends downwardly to the top edge of the mounting portion 20 and defines a first reference surface, while the top edges of the mounting portion include at least one and preferably two reference surfaces 24, 26, substantially normal to the neck 22, the reference surfaces acting to position the hook acurately within the hook mounting block. The blade 16 extends forwardly from the shank and defines the throat 28 at the forward end at the junction of the shank and blade, the blade thus extending from the throat and terminating at the forward end in a point or beak 30.

The clip 14 comprises a narrow resilient strip of spring steel including a substantially straight tail portion 32 which extends in elongated fashion substantially parallel to and spaced below the blade 16 of the hook and engages the beak 30 at a crease 34 formed in an enlarged end substantially triangular or flag portion 36. The portion 36 flares outwardly away from the hook engaging apex from the crease 34 at an angle for engaging and guiding a corresponding needle of the tufting machine between the blade 16 and the clip as the hook moves to seize a loop and, as is now notoriously well known in the art, the loop either may remain on the hook or be pulled passed the crease of the flag to selectively produce either a cut or uncut loop.

In general the prior art, as exemplified in the aforesaid Card U.S. Pat. No. 3,084,645 and in Parsons et al U.S. Pat. No. 4,241,676, generally includes an enlargement at the shank end of the clip to facilitate attachment thereof to the hook by means of rivets or the like. However, because in the finer gauge tufting instrumentalities there is limited space between adjacent gauge parts, it is desirable, if not mandatory, that the attachment of the clip to the hook be such that the attaching portion not protrude substantially beyond the face of the hook, and preferably not protrude at all. In the aforesaid Parsons et al patent the clip was bent so the intermediate portion between the attachment location and the flag was offset from the face engaging the flag beneath the blade toward the other face of the hook, but the attachment of the clip to the hook still resulted in a thicker section than desirable since attachment was by rivets. In the aforementioned hook known to be manufactured in Japan the clip was permanently attached by rivets or spot welds to a groove formed in the hook.

In the present invention a groove 38 is formed longitudinally in the surface 39 of one side of the mounting portion 20 of the hook, the slot being of a width and thickness for receiving a mounting portion of the tail portion 32 of the clip. Thus, the tail portion 32 forms a substantially planar continuation of the surface 39. Formed in the groove 38 are a pair of spaced female formations 40, 42, which preferably are holes extending to the mounting portion 20 of the hook. Formed in the clip at locations spaced apart an amount substantially equal to the spacing between the holes 40, 42 and disposed so that the crease 34 of the clip engages the bill are a pair of male formations which preferably are protuberences or small dimples 44, 46 extending from the adjacent face of the clip, and which may be formed by punching. The protuberence 44, 46 are adapted to be press-fit into the holes 40, 42 and snaped therein for firmly securing the clip to the hook, but are removable therefrom merely by prying the clip off the hook. When a clip must be replaced it is merely removed from the hook and a new clip rapidly attached. Thus, the hooks merely need to be loosened from the block 21 and slid out from the hook mounting slot, the clip is replaced and the hook is slid back into the block.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A combination cut/loop hook and clip for a tufting machine, said hook comprising a substantially planar body member including a blade and a shank, said blade extending forwardly from the shank and terminating at a loop seizing beak, an elongated mounting portion extending rearwardly from the shank for mounting within the tufting machine, a neck defining a reference surface formed at the rear of said blade above the shank and at least another reference surface formed on the upper edge of the mounting portion substantially normal to the neck, an elongated groove formed in one planar surface of the mounting portion, said clip comprising an elongated member having an enlargement at one end thereof and a substantially planar tail portion extending therefrom, at least a substantial part of said tail portion being of a width and thickness receivable within said groove so that a surface of said mounting portion within said groove and a surface of said part form corresponding abutting surfaces, and the opposite surface of said part forms a substantially smooth coplanar continuation of said planar surface, protuberence means defining at least one male formation on one of said corresponding abutting surfaces, recess means defining a like number of female formations in the other of said corresponding abutting surfaces, said female formations being of a size to cooperatively and securely receive a respective male formation, said enlargement having a crease disposed out of the plane of said tail and said groove and said formations being disposed such that said tail portion is spaced from said blade and said crease resiliently engages said beak.

2. The combination as recited in claim 1, wherein said protuberence means is formed on said tail and said recess means is formed in said groove.

3. The combination as recited in claim 2, wherein there are two male formations and two female formations, each like formation being spaced apart an equal amount.

4. The combination as recited in claim 3, wherein said female formations are holes extending through said mounting portion.

5. The combination as recited in claim 2, wherein said male and female formations are of a size such that they may be press-fit together and readily detached.

6. The combination as recited in claim 5, wherein there are two male formations and two female formations, each like formation being spaced apart an equal amount.

7. The combination as recited in claim 6, wherein said female formations are holes extending through said mounting portion.

* * * * *